US007001201B1

(12) United States Patent
Peng

(10) Patent No.: US 7,001,201 B1
(45) Date of Patent: Feb. 21, 2006

(54) MULTI-FUNCTION ELECTRICAL CONNECTOR

(75) Inventor: Juen Tien Peng, Chung Li (TW)

(73) Assignee: Action Electronics Co., Ltd., Chuing Li (TW)

( * ) Notice: Subject to any disclaimer, the term of this patent is extended or adjusted under 35 U.S.C. 154(b) by 0 days.

(21) Appl. No.: 10/960,071

(22) Filed: Oct. 8, 2004

(51) Int. Cl.
*H01R 13/627* (2006.01)

(52) U.S. Cl. ..... 439/358

(58) Field of Classification Search ..... 439/252–353, 439/357–358

See application file for complete search history.

(56) References Cited

U.S. PATENT DOCUMENTS 3,611,261 A * 10/1971 Gregory ..... 439/353
5,971,790 A * 10/1999 Rohde ..... 439/357
6,146,210 A * 11/2000 Cha et al. ..... 439/680
6,558,183 B1 * 5/2003 Ji et al. ..... 439/358

* cited by examiner

*Primary Examiner*—Ross Gushi
*Assistant Examiner*—Larisa Tsukerman

(57) ABSTRACT

A multi-function electrical connector, which has integrated functionality for connecting the signal terminals of an audio/video multimedia player with an external device. The electrical connector includes a plug connector and a receptacle connector containing appropriate signal terminals such as audio-right, audio-left, video-in, control, ground, etc. As a result, the connecting signals of the audio/video player with various external devices is simplified by gathering the signal lines together and simplifying the arrangement of the lines.

6 Claims, 4 Drawing Sheets

MULTI-FUNCTION ELECTRICAL CONNECTOR

BACKGROUND OF THE INVENTION

1. Field of the Invention

The present invention relates to an electrical connector, in particular, to a multi-function electrical connector for use with a portable digital audio/video multimedia player, which is convenient and versatile to use.

2. Description of the Prior Art

In a conventional audio/video player, such as a portable DVD player with display, the audio/video player not only can play CD, VCD, and DVD formats, but also can receive and display a signal from an external device, for example a TV or game machine. The signal lines are correspondingly connected one by one between the conventional audio/video player and the external device since the two devices do not have an integrated signal jack to collect terminals such as Video, Audio-L, Audio-R, IR, Gnd, and Control. In stead, separately corresponding signal jacks are disposed on the audio/video player for connecting the external device. Each signal jack takes up a relatively large area on the player. This limits the miniaturization of possible designs.

In addition, since there are multiple connecting cables, it is easy for users to make a mistake while connecting, thereby causing possible damage to the device. Also, the disorderly cables are unsightly and thereby negatively affecting the appearance of the product. This situation also makes it inconvenient for carrying. In view of the above, a multi-function electrical connector that overcomes the above-mentioned disadvantages is desired.

SUMMARY OF THE INVENTION

Accordingly, the present invention provides a multi-function electrical connector, which has integrated functionality for connecting the signal terminals of an audio/video multimedia player.

The present invention simplifies connecting signals of the audio/video player with various external devices, by gathering the signal lines together and simplifying the arrangement of the lines.

In order to achieve the aforementioned objects, the multi-function electrical connector of the present invention comprises a receptacle connector and a plug connector. The receptacle connector is mounted to the housing body of a portable audio/video multimedia player. The receptacle connector comprises an insulative housing and a plurality of terminals. At least one engagement portion is disposed on the sides of the insulative housing. The plug connector connects with the receptacle connector. The plug connector comprises a plug housing, a connection portion, at least one latch portion, and at least one press portion. The plug housing comprises a socket opening on a front portion of the plug housing and a chamber on at least one side of the plug housing. A groove is formed in the inner side of the plug housing. The plug connector is mounted in the socket opening on the front portion of the plug housing. The plug connector has a plurality of terminals corresponding to a plurality of terminals on the receptacle connector. The latch portion is embedded in the groove of the plug housing. The latch portion comprises a conducting portion on the front portion. The conducting portion is projected from the socket opening and positioned on the two sides of the plug connector. A crooked hook portion is mounted on a front end of the conducting portion and engages with the engagement portion of the receptacle connector. A press portion is positioned in the chamber of the housing and is involved with moving the latch portion.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENTS

Figure 1:
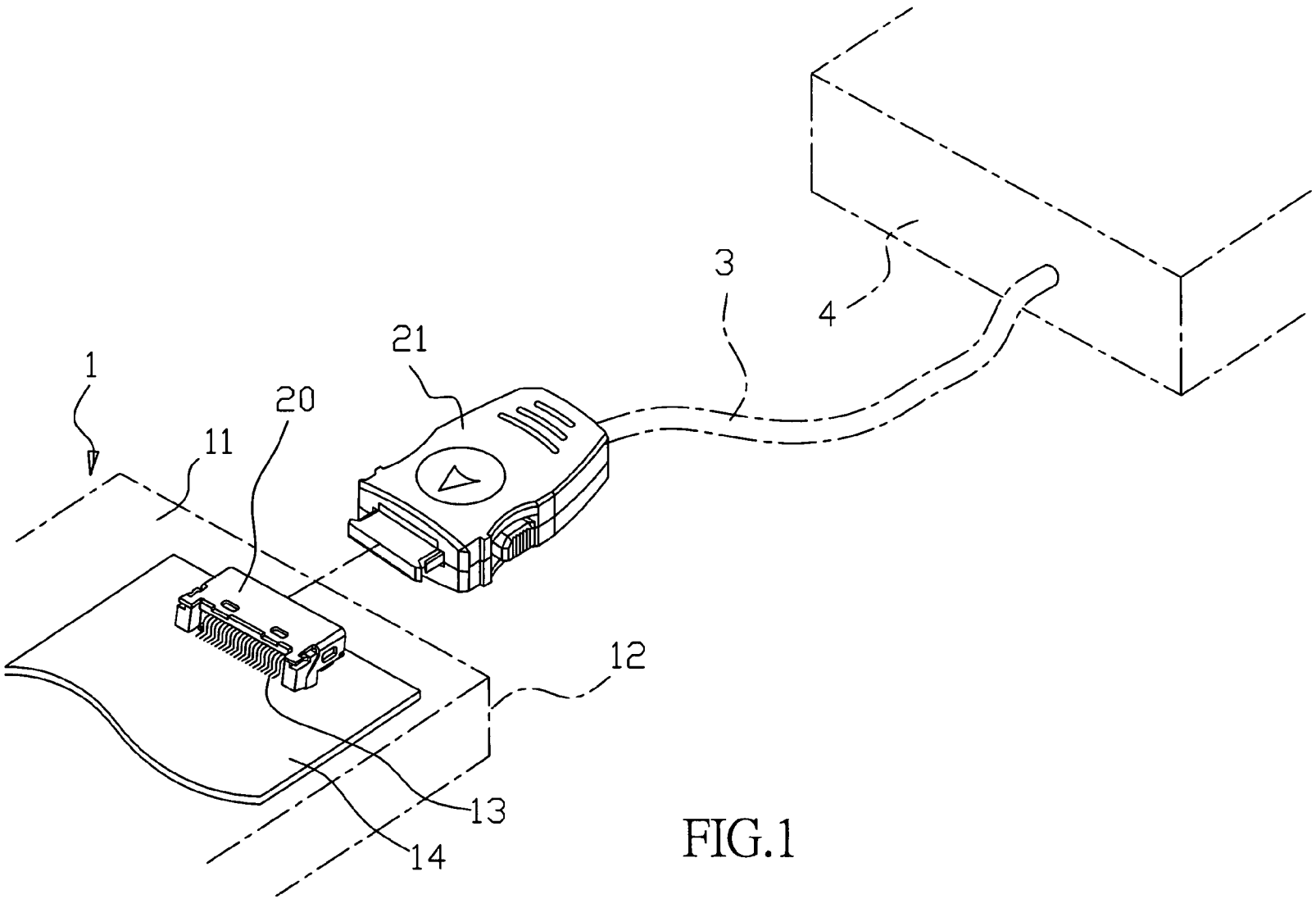
FIG. 1 is a perspective view of an electrical connector according to an embodiment of the present invention.

Referring to FIG. 1, a portable audio/video player 1 comprises a housing body 11. A receptacle connector 20 is disposed on the sidewall 12 of the housing body 11. A plurality of terminals 13 received in the receptacle connector 20 are electrically connected to a printed circuit board (PCB) 14 in the housing body 11. A plug connector 21 mates and connects to the receptacle connector 20. One end of a cable 3 is connected to the plug connector 21 and the other end is connected to an external device 4. The external device 4 can be a TV, game machine, or other electronic device. The external device 4 transmits audio/video signals to the portable audio/video player 1 after connecting the plug connector 21 and the receptacle connector 20.

Figure 2:
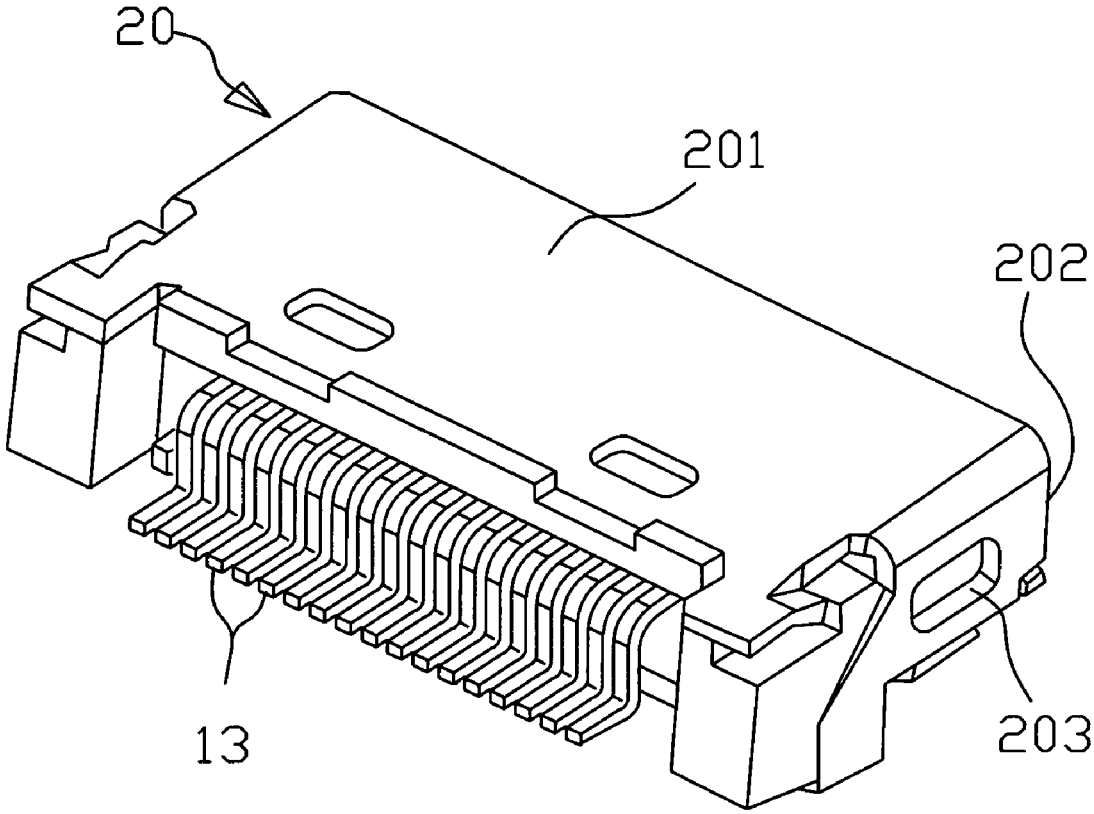
FIG. 2 is a perspective view of a receptacle connector according to an embodiment of the present invention.

Referring FIG. 2, which shows a receptacle connector 20 according to an embodiment of the present invention. The receptacle connector 20 comprises an insulative housing 201 and a plurality of terminals 13 received in the insulative housing 201. An inert portion 202 is disposed at the front section of the receptacle connector 20. Two engagement portions 203 are respectively disposed at two ends of the inert portion 202. The number of the terminals 13 can vary but in this embodiment there are 18-pins. Each terminal is defined as follows:

| Terminal | Definition |
|---|---|
| 1~5 | Vcc (+12 volt of power supply) |
| 6~8 | Vidi0 (input of audio/video) |
| 9 | Audio-L |
| 10~11 | Audio-R |
| 12~13 | IR |
| 14~17 | Gnd (ground signal) |
| 18 | Control (control signal) |

Figure 3:
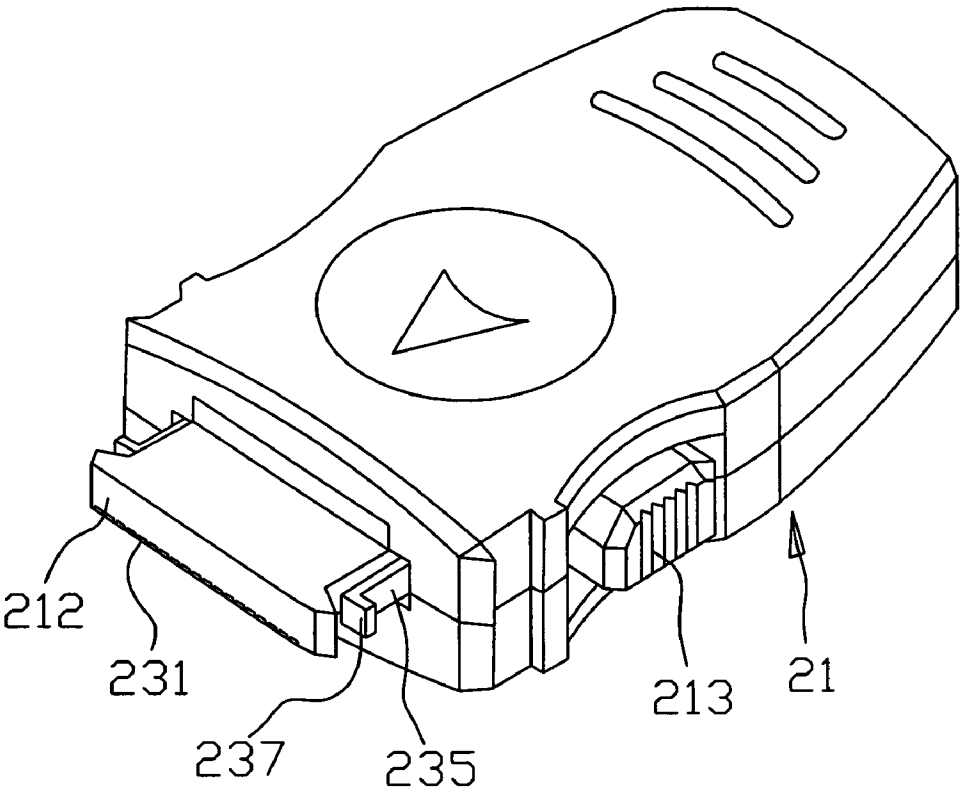
FIG. 3 is a perspective view of a plug connector according to an embodiment of the present invention.
Figure 4:
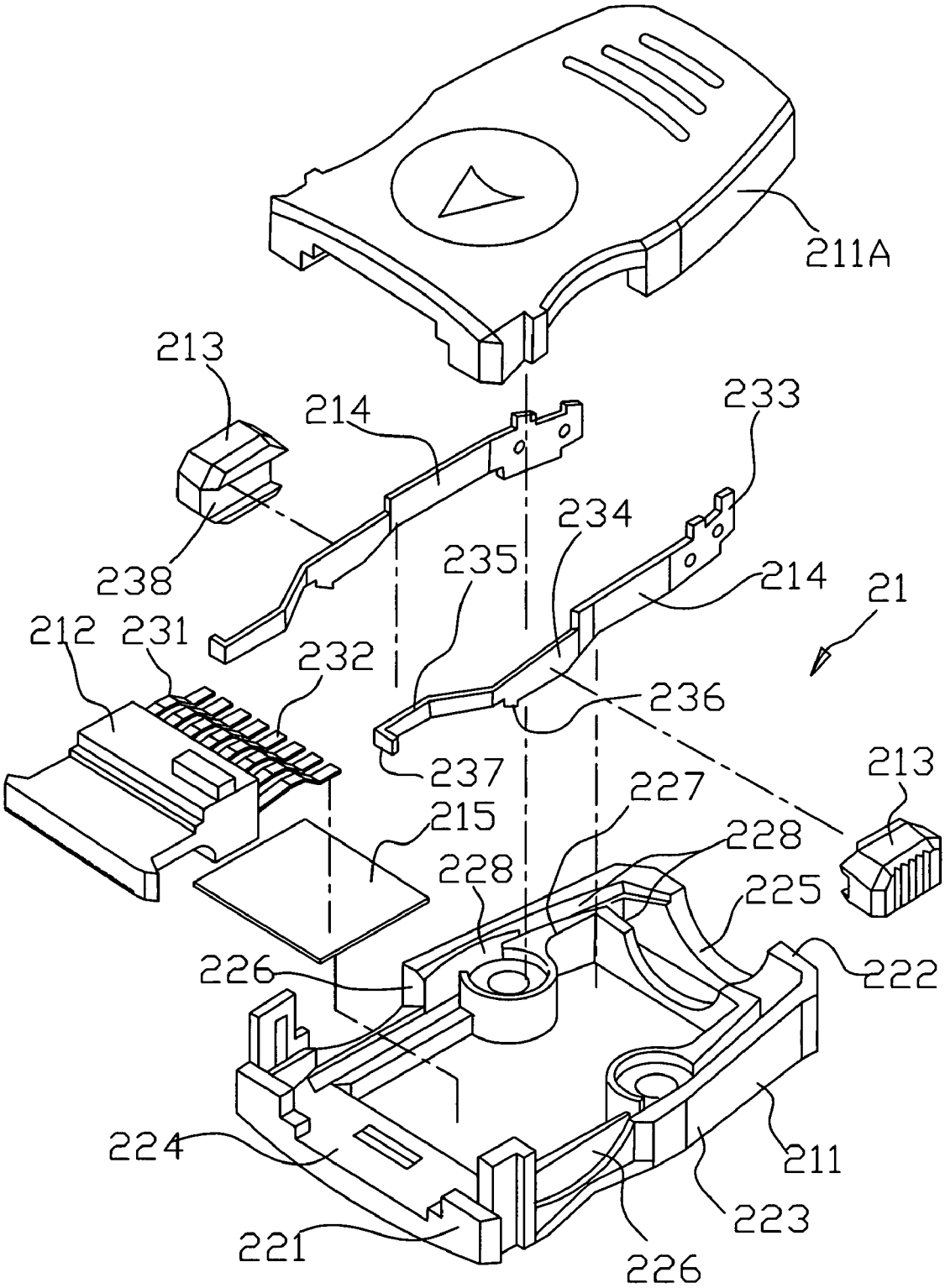
FIG. 4 is a disassembled perspective view showing an electrical connector according to an embodiment of the present invention.

Refer to FIGS. 3 and 4, which show a plug connector 21 according to an embodiment of the present invention. The plug connector 21 comprises two housings, a lower housing 211 and an upper housing 211A, a connection portion 212, two latch portions 213, two press portions 214, and a printed circuit board 215. The housings 211 and 211A are attached together to become a body of the electrical plug connector 21. The housing 211 (211A) comprises a front portion 221, a back portion 222, and two side portions 223. A socket opening 224 is at the front portion 221. A line socket 225 is at the back portion 222. A chamber 226 is at the side portion 223. An inner-ring wall 227 is disposed in the inside of the housing 221. A groove 228 is formed between the inner-ring wall 227 and the side portion 223. The connection portion 212 is in the socket opening 224 on the front portion of the housing 211 (221A). A plurality of terminals 231 (for example, 18 pins) are disposed on the connection portion 212. The leads 232 on the ends of terminals 231 are mounted to a printed circuit board 215 by Surface mount technology (SMT). Each terminal is defined as follows:

| Terminal | Definition |
|---|---|
| 1~5 | Vcc (+12 volt of power supply) |
| 6~8 | Vidi0 (input of visual/audio) |
| 9 | Audio-L |
| 10~11 | Audio-R |
| 12~13 | IR |
| 14~17 | Gnd (ground signal) |
| 18 | Control (control signal) |

The latch portions 213 are embedded in the grooves of the housings 221 (211A). The latch portion 213 comprises a power supply connection 233, a fixing portion 234 and a conducting portion 235. The power supply connection 233 is electrically connected with the printed circuit board 215 and the cable 3 (shown in FIG. 3). The cable 3 is led through the line socket 225 of the back portion 222 out of the housing 211 (211A). The projection 236 is on the fixing portion 234. The conducting portion 235 is projected from the opening socket 224, and is positioned on the side of connection portion 212. The crooked hook portion 237 is mounted on the front end of conducting portion 235.

When the plug connector 21 is connected with the receptacle connector 20, the crooked hook portion 237 engages with the engagement portion 203 of receptacle connector 20 in order to increase the stability of the connection. The press portion 214 is positioned in the chamber 226 of housing 211(211A) and is exposed out of the housing 211 (211A). A fixing groove 238 is mounted in the inner side of the latch portion 213. The fixing portion 234 is embedded in the fixing groove 238, so that the projection 236 stabs the fixing groove 238 to fix the position.

When the plug connector 21 is connected with the receptacle connector 20, the signal from the external device 4 is input to the portable audio/video player 1 through the cable 3, the plug connector 21 and the receptacle connector 20. If the plug connector 21 is to be readily disconnected with the receptacle connector 20, the press portion 214 of the plug connector 21 is pressed and involves moving the conducting portion 235 of the latch portion 231, so as to detach the crooked hook portion 237 from the engagement portion 203 to disassemble the plug connector 21. The operation of electrical connector is very convenient.

According to one aspect of the present invention, an electrical connector with multi-functions is provided. The signal terminal of an audio/video multimedia player is simplified for connecting various external devices, in order to prevent connecting and disconnecting a plurality of the lines.

While the invention has been particularly shown and described with reference to the preferred embodiments thereof, it will be understood by those skilled in the art that various changes in form and details may be made without departing from the spirit and scope of the invention.

What is claimed is:

1. A multi-function electrical connector comprising:

a receptacle connector mounted on a body of a portable audio/video player, the receptacle connector comprising an insulative housing and a plurality of receptacle terminals, and at least one engagement portion being disposed on sides of the insulative housing; and a plug connector connectable to the receptacle connector, the plug connector comprising a plug housing, a connection portion, at least one latch portion, and at least one press portion, the plug housing comprising a socket opening on a front portion of the plug housing, a chamber on at least one side of the plug housing, and a groove formed in an inner side of the plug housing, the connection portion mounted in the socket opening on the front portion of the plug housing, the plug connector having a plurality of plug terminals corresponding to the plurality of receptacle terminals on the receptacle connector, the latch portion embedded in the groove, the latch portion comprising a conducting portion projecting from the socket opening and positioned on two sides of the plug connector, a crooked hook portion mounted on a front end of the conducting portion and engaged with the engagement portion of the receptacle connector, and a press portion positioned in a chamber of the housing and involved with moving, the latch portion comprising a power supply connection and a fixing portion, wherein the power supply connection is electrically connected with a cable which is led through the line socket of the back portion out of the housing, wherein a fixing groove is mounted on the press portion, and a projection is mounted on the fixing portion, and the projection can stab the fixing groove to connect the latch portion.

2. The multi-function electrical connector of claim 1, wherein the plug connector is connected with a cable for connecting signals from an external device.

3. The multi-function electrical connector of claim 2, wherein there are 18 plug terminals and 18 receptacle terminals.

4. The multi-function electrical connector of claim 3, wherein the terminals between the plug connector and receptacle connector are defined as follows:

terminals 1~5 are defined as Vcc (+12 volt of power supply);

terminals 6~8 are defined as Vidi0(input of visual/audio);

terminal 9 are defined as Audio-L;

terminals 10~11 are defined as Audio-R;

terminals 12~13 are defined as IR;

terminal 14~17 are defined as Gnd (ground signal); and terminal 18 are defined as Control(control signal).

5. The multi-function electrical connector of claim 1, wherein a line socket is formed at a back portion of the plug connector.

6. The multi-function electrical connector of claim 1, wherein the receptacle connector further comprises a printed circuit board for electrically connecting with the plurality of receptacle terminals.

* * * * *